United States Patent [19]

Shevalenko et al.

[11] Patent Number: 4,536,698

[45] Date of Patent: Aug. 20, 1985

[54] METHOD AND APPARATUS FOR SUPPLYING VOLTAGE TO HIGH-OHMIC DUST ELECTROSTATIC PRECIPITATOR

[75] Inventors: Ilya S. Shevalenko; Anatoly V. Ilchenko; Vladimir I. Trush, all of Kharkov; Mikhail L. Vulis, Moscow; Anatoly I. Baryshnikov, Moscow; Igor P. Vereschagin, Moscow; Leonid M. Makalsky, Moscow; Garri Z. Mirzabekian, Moscow; Vladimir A. Smirnov, Moscow; Viktor P. Dzigan, Kharkov; Vladimir E. Ginzburg, Moscow; Vladimir I. Miroshnik, Moscow; Alexandr S. Minaev, Moscow; Alexandr V. Orlov, Moscow; Sergei P. Teljupa, Kharkov, all of U.S.S.R.

[73] Assignee: Vsesojuzny Nauchno-Issledovatelsky I Proektny Institut Po Ochikh Tke Tekhnologichesky Gazov, Stochnykh Vod I Ispolzovaniju Vtorichnykh Energoresursov Predpriyaty Chernoi Metallurgii Vnipichermetenergoochist Ka, Kharkov, U.S.S.R.

[21] Appl. No.: 526,481

[22] Filed: Aug. 25, 1983

[51] Int. Cl.[3] ..... B03C 3/68

[52] U.S. Cl. ..... 323/237; 323/903; 363/86; 55/105

[58] Field of Search ..... 323/237–242, 323/246, 320–321, 324, 291–292, 903; 55/105, 139; 307/72, 75, 82–86; 361/235; 363/85–88, 94, 128

[56] References Cited

U.S. PATENT DOCUMENTS

| | | | |
|---|---|---|---|
| 3,562,626 | 2/1971 | Morell | 363/86 |
| 3,648,437 | 3/1972 | Bridges | 323/903 X |
| 3,984,215 | 10/1976 | Zucker | 323/903 X |
| 4,233,039 | 11/1980 | Schmidt | 323/903 X |
| 4,354,152 | 10/1982 | Herklotz et al. | 323/903 X |
| 4,390,831 | 6/1983 | Byrd et al. | 363/86 X |

FOREIGN PATENT DOCUMENTS

| | | |
|---|---|---|
| 548315 | 2/1977 | U.S.S.R. . |
| 575629 | 10/1977 | U.S.S.R. . |

OTHER PUBLICATIONS

Aliev, "Agregaty Pitaniya Electrofiltrov," (1980), Gasenergoizdat, pp. 13–17 and 96–100.

Gernot Mayer-Schwinning, Rolf Rennhack "Neuere Erkenntnisse und Anwendungen bei der elecktrischen Abscheidung von Stauben und Nebelltropfchen," Chemie Ingenieur Technic 1980, 52, No. 5, pp. 375–383 (with English translation).

Z. L. Schwarts, V. V. Nagorny, Z. D. Gonozov, "Ispytaniya impulsnogo pytaniya electrofiltrov," Elektricheskie Stantzii, 1981, No. 2, pp. 61–66, (with English translation).

Harry J. White, "Electrostatic precipitation of fly ash", Journal of the Air Pollution Control Association, 1977, 27, No. 3, pp. 206–217.

Sigvaard Matts "Cold Side Precipitators", Journal of the Air Pollution Control Association, 1975, 25, No. 2, pp. 146–148.

*Primary Examiner*—Peter S. Wong

*Attorney, Agent, or Firm*—Lilling & Greenspan

[57] ABSTRACT

The method of supplying voltage to an electrostatic precipitator, includes periodically reversing the polarity of a supply voltage; intermittently supplying voltage to the precipitator; and the supply voltage polarity being reversed during no-voltage intervals, with the reversing of polarity being delayed with respect to the beginning of the no-voltage interval. An apparatus, for supplying voltage to a high-ohmic dust electrostatic precipitator, includes a step-up transformer including a thyristor controller placed in a primary winding circuit of the step-up transformer; a switching device connected to a secondary winding circuit of the transformer and to the precipitator, the switching device being made in the form of two transit pentodes having control solenoids whose axes are perpendicular to the axis of the corresponding pentode, the pentodes being in an inverse-parallel relationship; a regulating unit including a protection unit and being connected to the input of a thyristor controller, the protection unit having a thyristor key; and a control unit including a master oscillator having one output connected to a control electrode of the thyristor key in the protection unit and its other output connected through a flip-flop and power amplifiers to control solenoids of the transit pentodes.

11 Claims, 14 Drawing Figures

Prior art

METHOD AND APPARATUS FOR SUPPLYING VOLTAGE TO HIGH-OHMIC DUST ELECTROSTATIC PRECIPITATOR

FIELD OF THE INVENTION

The invention relates to electrical engineering, and is particularly concerned with a method and apparatus for supplying a high-ohmic dust electrostatic precipitator with electric current.

BACKGROUND OF THE INVENTION

To achieve a higher separation efficiency and reliability of electrostatic precipitators for suppression of high-ohmic dust is an important problem in the practice of removing suspended particles from gases by electrostatic precipitation. Because of the high electrical resistance of such dust most electrostatic precipitators used in power engineering, metallurgy, cement and chemical industries cannot provide for the required separation efficiency. At the same time frequent break-downs and a high rate of wear of the shaking mechanisms, while removing the layer of dust precipitated on the electrodes, affect the reliability and service life of electrostatic precipitators.

During the gas cleaning operation the dust particles are charged by the corona negative discharge produced in the interelectrode gap, that is between the corona-forming electrodes and precipitation electrodes, and are caused to deposit on the precipitation electrodes. When the specific electrical resistance of the dust to be removed is higher than $10^8$ Oh.m, a charge is accumulated under the action of the corona discharge current on the surface of the layer of dust so precipitated, while inside said layer an electric field is formed whose intensity becomes as high as 10 to 20 kv/ohm, which causes breakdowns in the dust layer. In this case in the breakdown regions on the precipitation electrodes there arise inverse corona discharges, wherefrom ions are emitted to the interelectrode gap, said ions having a polarity which is opposite to that of the corona-forming electrode. The positively charged ions neutralize a negative charge of the particles, thereby decreasing the charge or even inversing the polarity thereof, which in turn considerably decreases the velocity of the particles moving to the precipitation electrode and affects the separation efficiency.

The presence in the precipitator of an inverse corona discharge caused as a result of the drop of voltage across the layer of high-ohmic dust and the decrease of the electric strength of the interelectrode gap, the intensity of the electric field decreases, thereby decreasing the dust separation efficiency.

A high specific resistance of the high-ohmic dust is also responsible for the formation of a dust layer which is difficult to dislodge from the electrodes. Dislodging such a dust deposit requires a greater shaking impact force and a higher repetition frequency of shaking the electrodes. This affects the reliability of the shaking mechanisms in operation, and eventually impairs the dust separation efficiency as a whole.

DESCRIPTION OF THE PRIOR ART

At present a higher efficiency of the electrostatic precipitators in removing a high-ohmic dust from gases is mainly achieved by decreasing electrical resistance of the layer of dust precipitated, which is accomplished by treating or conditioning the gases to be cleaned with chemical reagents, such as for example, $NH_3$, $SO_3$ and the like (cf. Lagerdahl S. "Fly ash precipitators in Australia with particular reference to the state of New South Wales" Fläht Review, 1977, 12, pp 7–11, and also Mayer-Schwinning G., Rennhack R. "Neuere Erkenntnisse von Stauben und Nebeltropfchen", Chemie Ing-.Technik, 1980, 52, No. 5 pp 375–383), and also by cleaning gases at elevated temperatures of 300° to 400° C. (cf. Matts S. "Cold side precipitators", Journal of the Air Pollution Control Association, 1975, 25, No. 2, pp 146–148, and White H. J. "Electrostatic precipitation of fly ash", Journal of the Air Pollution Control Association, 1977, 27, No. 3, pp 206–217). This conditioning of the gases does not fully rule out the inverse corona discharge and only partially weakens the latter and involves the consumption of a large amount of chemical reagents. Moreover, said reagents also add to air pollution. Cleaning the gases at elevated temperatures leads to an increase in the volume of gases being cleaned and requires the use of high-temperature electrostatic precipitators, which, in turn, leads to higher costs of the gas cleaning operations. Conditioning the gases being cleaned with the aid of chemical reagents and higher temperature is used in a limited range of temperatures and physicochemical properties of the dust and does not completely solve the problem of raising the efficiency of removing a high-ohmic dust from gases by electrostatic precipitation.

The detrimental effect that a high electrical resistance of the dust being precipitated has on the precipitation efficiency may be diminished by using special modes of supplying electric current to electrostatic precipitators. Various modifications of pulsed supplying electric current to electrostatic precipitators are developed at present in the USSR (cf. Shwarts Z. P. "A device for supplying electrostatic precipitators with electric current", USSR Author's Certificate No. 575,629, Cl. B03C 3/68, C05T 1/22, 1977, Bulletin No. 37, and also Shwarts Z. L., Nagorny B. B., Gonozov A. D. "Ispytaniya impulsnogo pytaniya elektrofiltrov", Elektricheskie Stantzii, 1981, No. 2, pp 61–66), in the United States (cf. Komar K. S., Feldman P. L., Middle H. J., Shubert C., "The results of first fullscale utility demonstration of pulsed precipitation", Ind.Annual Meet., Clevelend, Ohio, 1979, Cont. cer., New York., 1979, 1333–37), and in the Federal Republic of Germany (cf. FRG Application No. 2,713,675, Int.Cl. B03C 3/66). In the case of a pulsed mode of the voltage supply a partial discharge in the dust layer takes place within the intervals between the supply pulses, which reduces the probability of a breakdown of the layer and decreases the inverse corona discharge. However, a pulsed supply of electric current does not completely eliminate the inverse corona discharge and enables the remainder dust content in the gas after electrostatic precipitation to be reduced in average only two times. In addition, this type of voltage supply does not solve the problem of removing a difficult-to-dislodge dust layer from the electrodes.

There is known a method wherein electrostatic precipitators are supplied with an asymmetric alternating voltage of commercial frequency, which is effected by superposing direct voltage of a negative polarity with an alternating voltage having a sinusoidal waveform and a frequency of 50 Hz (cf. FRG Pat. No. 1,206,397, Int. Cl. B03C 3/38). In this method of electric current supply the layer of dust, on the surface of which a negative charge is accumulated during a half-period of the voltage of a negative polarity, discharges during the following half-period of positive polarity and lower amplitude. The use of an asymmetric voltage favours decreasing of the inverse corona discharge intensity and adhesion strength of the dust layer on the electrodes.

The disadvantage of the above method of supplying electrostatic precipitators with an asymmetric voltage is that the particles are not fully charged because of being alternately recharged to opposite polarity at a frequency of 50 Hz. In this case the duration of their presence in the field of the corona discharge of one polarity does not exceed 0.01 sec. A charging time which is necessary for the particles to be fully charged is about 0.1 sec. Furthermore, during the positive half-period of the asymmetric voltage the intensity of the electric field in the electrostatic precipitator is much lower than during the negative half-period. These factors affect the efficiency of cleaning operation and are responsible for the fact that asymmetric voltage is not practically used for the above purpose.

There is also known a method wherein electrostatic precipitators are supplied with a voltage of reversing polarity (cf. USSR Author's Certificate No. 548,315, Int.Cl. B03C 3/38) which allows the inverse corona discharge to be fully eliminated and provides for self-cleaning of the precipitation electrodes.

In this method the polarity of the supply voltage is periodically reversed so that during the corona discharge of each polarity the particles are fully charged and then efficiently deposited in the electric field, and the charge accumulated on the layer of dust never assumes its critical value, thus ruling out breakdowns in the layer. Periodically reversing the sign of the charge of the layer of a high-ohmic dust prevents the occurrence of the inverse corona discharge and provides for a precipitation efficiency which is as high as that which is obtained in depositing a low-ohmic dust.

Furthermore, because the charge is neutralized when the polarity is reversed, the electrical component of the adhesion strength decreases so that, when the deposited dust layer reaches a certain thickness, the dust falls down in layers, thus providing for a self-cleaning of the precipitation electrodes. The self-cleaning phenomenon makes it possible to omit the shaking mechanism.

Shown in FIG. 1 is a photograph of a dust layer formed on the surface of the precipitation electrodes of the electrostatic precipitator which is supplied with a voltage whose polarity is periodically inversed and which is not fitted with a shaking mechanism. FIG. 2 is a schematical representation of photographing the electrodes. Photographing the electrodes was done with the use of a camera 111 disposed at a certain angle to the precipitation electrodes 112 (FIGS. 1 and 2) between which are located the corona-forming electrodes 113 and a tubular frame 114 for mounting the corona-forming electrodes 113.

The photograph in FIG. 1 shows the portions 116 of the clean surface of the precipitation electrode 112 at the places where the dust layer has fallen down and also the portions of the surface of the electrode with the dust layer thereon which is about 1 cm thick. The displacement of the deposited dust by gravity occurs periodically as the thickness of individual portions of the dust layer increases. The layer of dust so formed does not prevent the particles from depositing and may be fully displaced, if necessary, by impacting the precipitation electrode.

When employing a supply voltage of reversing polarity for separation of a high-ohmic dust in an electrostatic precipitator, the separation efficiency improves with the increase in the specific electrical resistance of the dust being separated and the intensity of the corona discharge.

However, considerable difficulties of technical nature are encountered in utilizing the above method in the electrostatic precipitators for industrial application. Due to the precipitator capacitance and the power-supply source inductance, a considerable overvoltage occurs in the power-supply circuit, which overvoltage causes breakdowns in said power-supply circuit and disturbs operation of the power-supply source.

SUMMARY OF THE INVENTION

The principal object of the invention is to provide a method and apparatus for supplying voltage to a high-ohmic dust electrostatic precipitator, which due to a more reliable and efficient construction prevent occurrence of an overvoltage, thereby ruling out breakdowns in the power-supply circuit.

This and other objects are attained by a method of supplying voltage to a high-ohmic dust electrostatic precipitator having precipitation and corona-forming electrodes, which comprises periodically reversing the polarity of the supply voltage; and, according to the invention, the supply voltage is applied to the electrostatic precipitator intermittently, with the interruption of voltage supply coinciding with the reversal of the supply voltage polarity and reversing the supply voltage polarity being delayed with respect to the beginning of said interruption of voltage supply.

Such a method rules out overvoltages, and hence breakdowns in the power-supply circuit, thereby enhancing the reliability of the apparatus for carrying out said method.

The highest separation efficiency in the precipitator may be achieved by maintaining the supply voltage between the no-voltage intervals at a prebreakdown level, which is effected by measuring the potential of the dust layer deposited on the precipitation electrodes of the electrostatic precipitators and varying the voltage applied thereto proportionally to the potential being measured so that said supply voltage applied to the precipitator corresponds to the prebreakdown voltage.

A modification of the proposed method is possible, wherein the duration of applying the voltage of each polarity within the period between the no-voltage intervals is selected depending on the electric field intensity in the layer of dust deposited on the precipitation electrodes of the precipitator.

Said object is also attained by an apparatus for supplying voltage to a high-ohmic dust electrostatic precipitator having precipitation and corona-forming electrodes, which according to the invention includes a step-up transformer; a thyristor controller placed in the primary winding circuit of the step-up transformer; a switching device connected in series to the secondary winding circuit of the transformer and the electrostatic precipitator, said switching device made in the form of two transit pentodes connected in antiparallel to one another and each provided with a control solenoid with the axis of said control solenoid being perpendicular to the axis of the corresponding pentode; a regulating unit including a protection unit and connected to an input of the thyristor controller, said protection unit having a thyristor key; a control unit having a master oscillator whose first output is connected with a control electrode of the thyristor key in the protection unit and whose other output is connected through a flip-flop and power amplifiers to the control solenoids of the transit pentodes.

Such construction of the apparatus for carrying out the proposed method, wherein said pentodes are used, is the most expedient, since with a relatively small size and low cost it ensures a high reliability in operation. In addition, the high internal dynamic resistance of transit pentodes limits the magnetizing current of the electrostatic precipitator and in the case of breakdowns decreases the energy of spark discharges, which, in turn, rules out possible burn-outs of the corona-forming electrodes, which may occur as a result of said breakdowns when a high-power source of supply is used.

For the purpose of regulating the duration of the voltage application period of each polarity, the proposed apparatus may be provided with four voltage pick-ups, each having one lead connected to a corresponding lead of a corresponding pentode; the control unit includes a comparison circuit having its input connected to the other leads of the voltage pick-ups; a function generator is connected to the input of said comparison circuit; and the regulating unit includes a pulse converter placed in a circuit between the protection unit and the thyristor controller and connected to an output of the function generator in the control unit.

A modification is also possible wherein, for maintaining the supply voltage at a prebreakdown level during the period between the no-voltage intervals, the apparatus is provided with a voltage pick-up having one lead connected to the precipitation electrode of the precipitator, and wherein the control unit includes a function generator having its input connected to the other lead of the voltage pick-up. The regulating unit includes a pulse converter placed in a circuit between the protection unit and the thyristor controller and has one input connected to the function generator of the control unit.

Said object is also attained by an apparatus for carrying out the proposed method, which includes two step-up transformers, each having a thyristor controller placed in the primary winding circuit of said transformer; two high-voltage rectifiers, each placed in parallel in the secondary winding circuit of a corresponding transformer and provided with two high-voltage leads having opposite polarity, one of said leads being grounded; two series-connected transit pentodes, each having a control solenoid, the axis of said each control solenoid being perpendicular to the axis of the corresponding pentode; leads electrically connected to said electrostatic precipitator and the other transit pentode, and other leads electrically connected to leads of the high-voltage rectifiers; a regulating unit provided with a protection unit and connected to the input of the thyristor controller, said protection unit having a thyristor key; and a control unit including a master oscillator having two outputs each connected to a control electrode of the thyristor key in the protection units, and its third output connected through a flip-flop and power amplifiers to the control solenoids of a corresponding transit pentode.

In this case two modifications are possible.

In the first modification the series connection of the transit pentodes is effected by connecting the cathode of one of the pentodes to the cathode of the other pentode, with their common point of connection being connected to the precipitator, the anode of the first pentode being connected with a negative high-voltage lead of one of the high-voltage rectifiers whose positive high-voltage lead is grounded, and the cathode of the other pentode being connected to the positive high-voltage lead of the other high-voltage rectifier whose negative high-voltage lead is grounded.

In the other modification of the proposed apparatus a series connection of the pentodes is effected through one of the high-voltage rectifiers, the anode of one of the pentodes being connected with a negative lead of the corresponding high-voltage rectifier whose positive high-voltage lead is grounded, the cathode of the same pentode being connected with a positive high-voltage lead of the other high-voltage rectifier having its negative lead grounded through the other pentode placed in a circuit including the high-voltage rectifier and earth, and having its anode connected to the negative high-voltage lead of the high-voltage rectifier.

Said object is also attained by an apparatus for supplying voltage to a high-ohmic dust electrostatic precipitator having precipitation and corona-forming electrodes, which, according to the invention, comprises a power source having two high-voltage leads of opposite polarities; a high-voltage switch having control coils and being connected to the precipitator; an electric field intensity transducer having its lead connected to the precipitator; and a control unit including two series-connected diodes, to the common connection point of some leads of said diodes is connected the other lead of the electric field intensity transducer, while the other leads of said diodes are connected to a comparison circuit, and the control unit also including power amplifiers having their inputs connected to outputs of the comparison circuit, and the output of the corresponding amplifier being connected to the corresponding control coil of the high-voltage switch.

BRIEF DESCRIPTION OF THE DRAWINGS

The invention will now be explained with reference to embodiments thereof which are represented in the accompanying drawings, wherein.

DETAILED DESCRIPTION OF THE INVENTION

Figure 1:
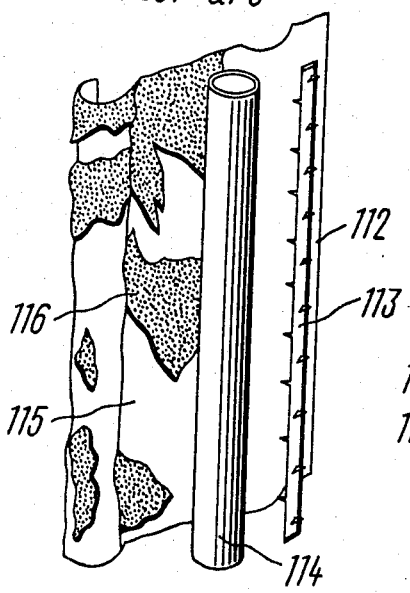
FIG. 1 Prior art
FIG. 1 is shows a portion of the corona-forming and precipitation elecrodes, which illustrates self-cleaning of the precipitation electrodes from the layer of dust deposited on their surface, according to the prior art method.
Figure 2:
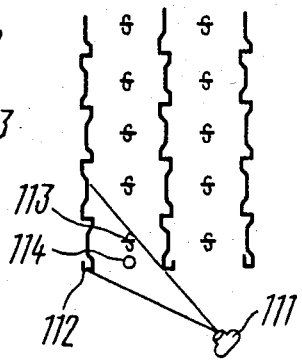
FIG. 2 schematically represents photographing the corona-forming and precipitation electrodes of FIG. 1.
Figure 3:
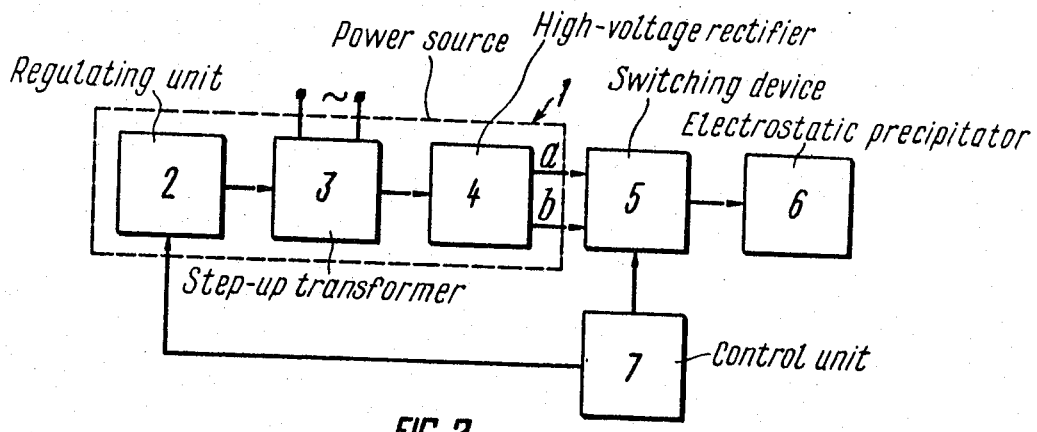
FIG. 3 is a block-diagram showing a method of supplying voltage to an electrostatic precipitator according to the invention.

An apparatus for carrying out the proposed method, represented in the form of a block-diagram in FIG. 3, comprises a power source provided with two high-voltage leads "a" and "b" and having a series circuit composed of a regulating unit 2, a step-up transformer 3, and a high-voltage rectifier 4; and a switching device 5 connected to the power source 1 and also to an electrostatic precipitator 6. Voltage supply conditions are controlled by a control unit 7 connected to the switching device 5 and the regulating unit 2.

When the voltage supply of the electrostatic precipitator is effected according to the above block-diagram, an alternating voltage (in this particular case) of a commercial frequency from a 380 V supply line is applied to the regulating unit 2 wherein said alternating voltage is regulated to a level which is determined depending on the specified voltage and current supply of the electrostatic precipitator 6, whereafter it is stepped-up by the transformer 3 and then rectified by the high-voltage rectifier 4. The switching device periodically reverses the polarity of the thus rectified voltage so that to the corona-forming electrodes is alternately applied a voltage of positive or negative polarity.

The waveform, amplitude and the length of the voltage signal of each polarity are set with the aid of the control unit 7 and selected by their optimum values depending on the properties of the dust being separated, and in particular the electrical resistance of said dust. In this case use may also be made of a sign-inverting voltage with a square waveform of 1 Hz and equal voltage signal length of each polarity.

Figure 6:
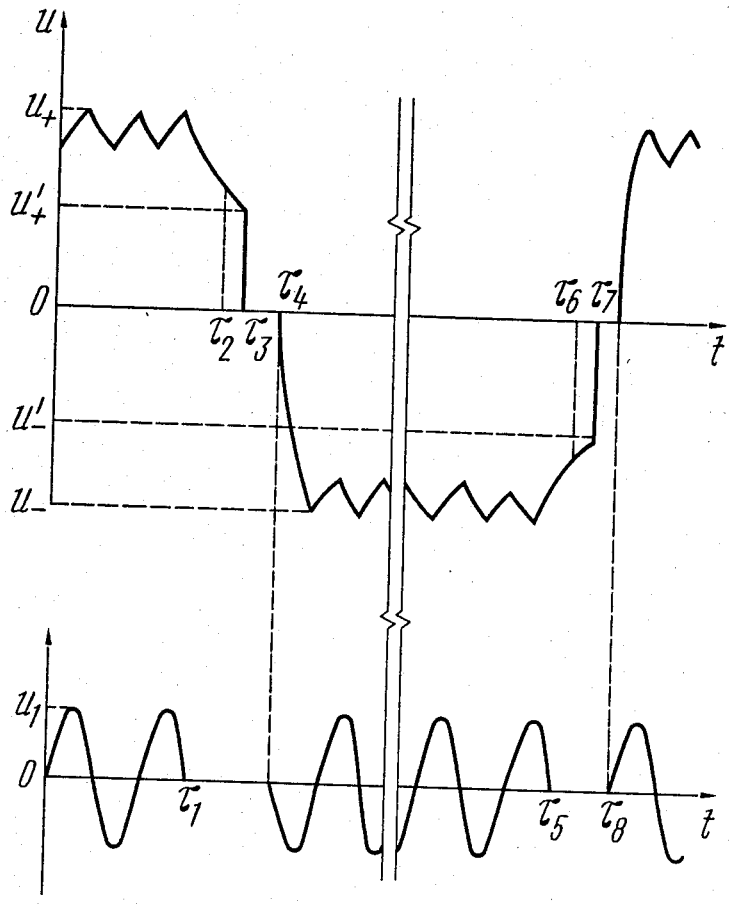
FIG. 6 is a graph, showing reversing of the polarity of a supply voltage according to the invention.

Reversing the voltage polarity, for the case when the electrostatic precipitator is supplied with voltage according to the proposed method, is illustrated by the diagram in FIG. 6 and effected as follows. When, for instance, the precipitator is supplied with a voltage of a positive polarity and amplitude U+, to the primary winding of the step-up transformer 3 is applied an alternating voltage of 50 Hz and amplitude $U_1$. When the polarity of the supply voltage is reversed, the primary of the transformer 3 at a moment of time $\tau_1$ is disconnected from the supply line so that the precipitator is de-energized. Since the supply current does not flow from the power source, the precipitator 6 capacity is caused to discharge by the corona discharge current, and the voltage across the precipitator 6 drops from U+ to a residual value U+' which is close to the initial corona discharge voltage.

At a moment of time $\tau_2$ the precipitator 6 is disconnected from the lead "a" of one polarity of the supply source and at a moment of time $\tau_3$ is connected to the lead "b" of the opposite polarity. At the moment when the precipitator 6 is connected to the lead "b" of the opposite polarity, the capacity of the precipitator 6 becomes fully discharged and the voltage across said precipitator falls to assume a zero value. Then at a certain moment of time $\tau_4$ the primary of the transformer 3 is again connected to the supply line to energize the precipitator 6 again, but this time, however, said precipitator is supplied with a voltage of a negative polarity U−.

Reversing the voltage polarity from negative U− to positive U+ is effected in a similar way, as disclosed above. At a moment of time $\tau_5$ the transformer 3 is disconnected from the supply line, whereafter at a moment of time $\tau_6$ the precipitator is disconnected from the lead "b", at a moment of time $\tau_7$ the precipitator is connected to the lead "a", and then at a moment of time $\tau_8$ the transformer 3 is connected to the supply line again.

Such polarity reversal is effected periodically with the aid of the control unit 7 in accordance with a preset program. The length of intervals between the switching operations and the repetition frequency corresponding thereto are selected so that the length of the voltage signal of each polarity does not exceed a period of time which is necessary for the potential of the dust layer to reach its critical level and cause a breakdown, that is a time which is sufficient for a reverse corona discharge to occur in the precipitator 6.

Due to disconnection of the primary winding of the transformer 3 from the supply line, the reversal of voltage polarity in the precipitator 6 proceeds smoothly, without voltage surges and current inrushes, thereby ruling out overvoltages in the supply circuit.

In order to minimize the lost of time required for switching, the intervals $\tau_1-\tau_3$ and $\tau_5-\tau_7$ are selected as short as possible at a minimum potential difference across the switching device 5 which is a high-voltage switch. To this end, connecting the precipitator to the lead of the opposite polarity at the moment of time $\tau_3$ is delayed for 1 to 3 half-periods, that is 0.01 to 0.03 sec after the power source is disconnected from the supply line. During this time the voltage accross the precipitator drops from U+ to U+' (approximately by half) due to the fact that the capacity of the precipitator 6 is discharged by the corona discharge current. This rules out a double over-voltage across the switching device 5 when the precipitator is connected to the power source lead of the opposite polarity at the moment of time $\tau_3$. The time period $\tau_2-\tau_3$ also does not exceed several half-periods, and when interialess electronic switches are used said time period $\tau_2-\tau_3$ may equal zero.

In this case the total duration of the no-voltage position of the precipitator, while reversing the supply voltage polarity, does not exceed 0.05 sec which at a switching repetition frequency of 1 Hz corresponds to a lost of time not more than 5%.

To improve the efficiency of using a sign-inverting voltage it is necessary that during the periods between the no-voltage intervals the potential between the corona-forming electrodes and the dust layer on the precipitation electrodes of the electrostatic precipitator be maintained at a pre-breakdown level. This is achieved by measuring the potential of said dust layer and regulating the voltage applied to the precipitator proportionally to the measured value of said potential.

The block-diagram (FIG. 4) explaining this modification of the proposed method includes a power source 1 comprising a series circuit including a regulating unit 2, a step-up transformer 3, and a high-voltage rectifier 4. It further includes a switching device 5 connected to the power source 1 and electrically connected with the precipitator 6 and a control unit 7. Outputs of the control unit 7 are connected to the switching device 5 and the regulating unit 2. In addition, one or several voltage pick-ups are mounted on the precipitation electrodes of the precipitator in order to provide a feedback in the supply circuit to control operating conditions, said voltage pick-ups are adapted to measure potential of the dust layer and have their outputs connected to the control unit 7.

A signal applied from the pick-ups 8, proportional to the drop of voltage across the layer of dust, is converted in the control unit 7 and then transmitted to the regulating unit 2 and the switching device 5.

Each time when the supply voltage polarity is reversed, the layer of dust has at the beginning a charge accumulated as a result of the corona discharge of the previous polarity. Therefore, the dust layer potential is negative with respect to the potential across the corona-forming electrodes to which has been already applied the voltage of opposite polarity, and hence increases the absolute value of the potential difference between the corona-forming electrodes and the layer of dust.

In order to prevent a breakdown in the interelectrode gap (see diagram in FIG. 4), which may occur when the supply voltage of opposite polarity is applied, the amplitude of said supply voltage applied to the precipitator is decreased at the beginning. Then, as the dust layer is recharged and a new charge of an opposite polarity is accumulated so that a potential of the same polarity increases, the amplitude of the supply voltage is increased. Due to this a maximum potential difference is continuously maintained across the gas flow path within the interelectrode gap, which potential difference corresponds to the prebreakdown voltage, thereby maintaining a maximum electric field intensity, and thus improving the gas cleaning efficiency.

In another modification of the proposed method the length of a supply voltage signal of each polarity applied to the precipitator (FIG. 5) between the no-voltage intervals is selected depending on the electric field intensity in the layer of dust deposited on the precipitation electrodes of the precipitator 6.

Figure 5:
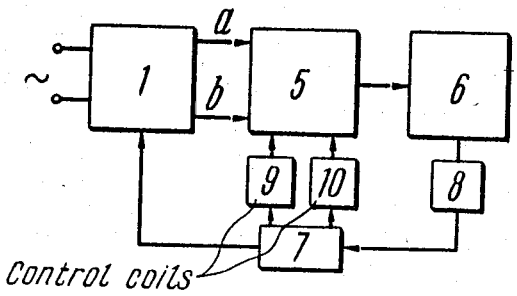
FIG. 5 is a block-diagram showing another modification of the method according to the invention.

The block-diagram explaining this modification of the proposed method, shown in FIG. 5, includes, like in the previous case, a power source 1 provided with two high-voltage leads "a" and "b", a switching device 5, electrostatic precipitator 6, and a control unit 7. In this case the switching device is an electromagnetic switch having control coils 9 and 10, and the pick-up 8 mounted in the precipitator is an electric field intensity transducer connected through the control unit 7 with the coils 9, 10 of the switching device 5.

According to this modification a signal from the transducer 8, proportional to the electric field intensity in the layer of dust deposited on the precipitation electrodes of the precipitator 6, is applied to the control unit 7. When the electric field intensity in said layer of dust reaches a prebreakdown level, a control signal is formed in the control unit 7, which control signal is applied to the control coils 9 and 10 of the switching device 5 so as to cause reversal of the voltage polarity, thereby ruling out breakdowns in the dust layer on the precipitation electrode and occurrence in the precipitator of a reversed corona discharge.

The proposed method utilizing a sign-inverting supply voltage was carried out in 4th section (which is the last one when viewed in the direction of the gas flow) of the electrostatic precipitator Y12-4-37 installed after a rotary kiln for firing of magnesite. As a source of a voltage of reversing polarity use was made of two supply units AТΦ-400 fitted with voltage thyristor controllers. From the output of one unit was applied a high voltage of a negative polarity, and from the output of the other unit was applied a high voltage of a positive polarity. The high-voltage leads of the units of the both, i.e. opposite polarities were connected to the precipitator through electromagnetic switches. The switches were operated with the aid of an automatic control unit which enabled regulating the length of the voltage signal of each polarity.

Signals from the control unit were applied to the control coils of the high-voltage switching devices and to the voltage regulators to disconnect the units from the supply line.

Due to the fact that the units were disconnected from the supply line, no overvoltages occurred in the supply circuit of the precipitator when the supply voltage was switched. As compared to the prior art method utilizing direct voltage as a supply voltage, the proposed method enabled the residual content of dust after electrostatic precipitator to be reduced 2 to 2.5 times. When the electrostatic precipitator was supplied with a sign-inverting voltage, the shaking mechanisms were switched off, and the dust deposited on the electrodes fell down by gravity.

Monitoring the residual dust content in the gas after treatment in the precipitator with the aid of an optical dust counter has shown that a secondary entrainment of the dust, which takes place during shaking of the precipitation electrodes in the prior art method using a single-polarity voltage supply, does not occur when the electrostatic precipitator is supplied with a voltage of reversing polarity.

An apparatus for supplying voltage to a high-ohmic dust electrostatic precipitator, which is proposed for carrying out the method of the invention comprises two step-up transformers 11 and 12 (FIGS. 7 and 8), each having a thyristor controller 13 or 14, respectively, placed in the primary winding circuit of said corresponding transformer; regulating units 15 and 16; high-voltage bridge rectifiers 17, 18, each having a positive and a negative high-voltage leads; transit pentodes 19 and 20 placed in series in the supply circuit of the electrostatic precipitator 21; and a control unit 22.

The thyristor controllers 13 and 14, which are made in the form of two inverse-parallel connected thyristors, and the regulating units 15 and 16 are constructed in a similar manner as shown on the block-diagram of the power-supply unit AТΦ (cf. G. M. A. Aliev "Agregaty pitaniya electrofiltrov", M. 1980, Gosenergoizdat, p.96). The regulating units 15 and 16 include protection units 23 and 24 respectively, which protection units in the general case are adapted to disconnect the apparatus from the supply line in the case of breakdowns in the electrostatic precipitator 21. The protection units 23 and 24 have at least one thyristor key (not shown in the drawings) incorporating a thyristor adapted to disconnect the apparatus from the supply line in response to an external control signal.

The control unit 22 includes a master oscillator 25, a flip-flop 26, and power amplifiers 27 and 28. Two outputs of the master oscillator 25 are connected to control leads of the thyristor keys in the protection units 23 and 24, and the third output of said master oscillator is connected to the input of the flip-flop 26 having its outputs connected through the power amplifiers 27 and 28 to the leads of the control solenoids 29 and 30 of the corresponding transit pentodes 19 and 20.

The transit pentodes 19 and 20 (FIG. 7) are placed in the supply circuit of the electrostatic precipitator 21 so that the cathode of the transit pentode 19 is connected to the corona-forming electrodes of the electrostatic precipitator 21, and the anode of the same pentode is connected to a negative high-voltage lead of the high-voltage rectifier 17. The transit pentode 20 has its cathode connected to a positive high-voltage lead of the high-voltage rectifier 18 and its anode connected to the corona-forming electrodes of the precipitator 21. In this case a positive lead of the high-voltage rectifier 17 and a negative lead of the high-voltage rectifier 18 are grounded.

A modification of the proposed apparatus is possible wherein the transit pentode 20 (FIG. 8) is placed in the supply circuit of the precipitator 21 between the high-voltage rectifier 18 and the ground, in which case the anode of the transit pentode 20 is connected to the negative lead of the high-voltage rectifier 18 and the cathode of said pentode is grounded. The positive lead of the high-voltage rectifier 18 is connected to the corona-forming electrode of the precipitator 21. Such construction of the apparatus is much simpler and improves the operating reliability thereof.

Figure 7:
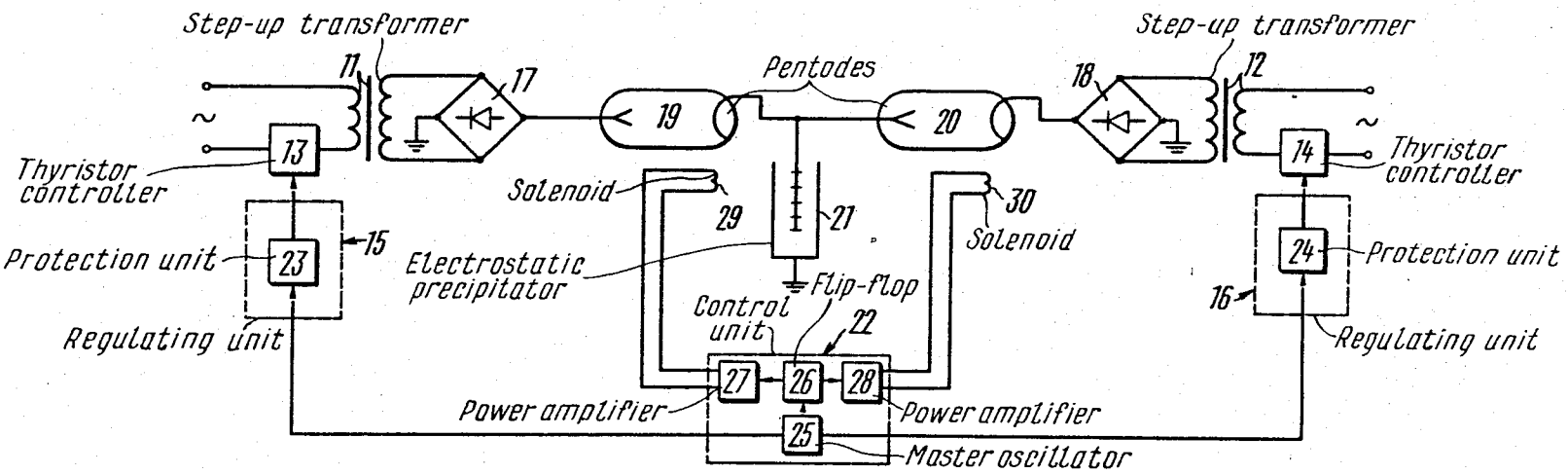
FIGS. 7 and 8 are diagrams of two modifications of one apparatus for supplying voltage to a high-ohmic dust electrostatic precipitator according to the invention.
Figure 8:
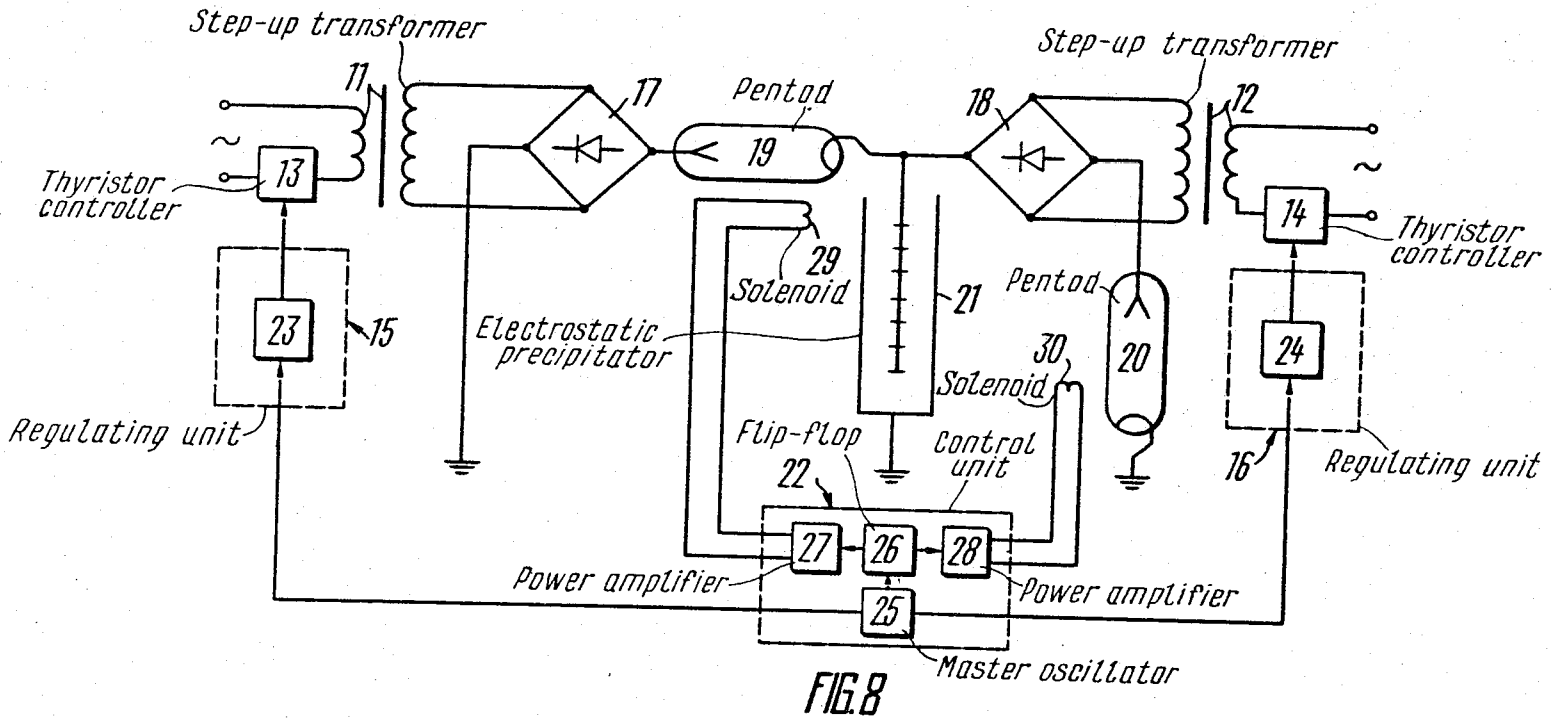

The apparatus whose modifications are illustrated in FIGS. 7 and 8 operate in the following manner. A high voltage, for instance of a negative polarity, is applied from the lead of the rectifier 17 through the transit pentode 19 to the electrostatic precipitator 21. Before switching of said high voltage, the thyristor controller 13, in response to a signal applied from the master oscillator 25 of the control unit 22 to the input of the protection unit 23 in the regulating unit 15, disconnects the transformer 11 from the supply line. Then, in response to signals applied from the power amplifiers 27 and 28 of the control unit 22 to the control solenoids 29 and 30, the transit pentode 19 is rendered non-conducting, and the transit pentode 20 is caused into an ON-state. Whereafter, on a signal from the master oscillator 25 of the control unit 22 applied to the protection unit 24 of the regulating unit 16, the thyristor controller 14 connects the transformer 12 to the supply line, in which case a supply voltage of a positive polarity is applied to the precipitator from the rectifier 18.

Such construction of the apparatus to supply the precipitator with a voltage of inverting sign and a full-wave rectification provides for maximum voltage and current applied to the precipitator. However, this modification involves the use of two step-up transformers and two rectifier bridges, which leads to a larger size, greater weight and higher cost of the apparatus. Furthermore, each transformer operates for a time constituting only 50% of the total operating time of the precipitator, which makes it less economic.

Figure 9:
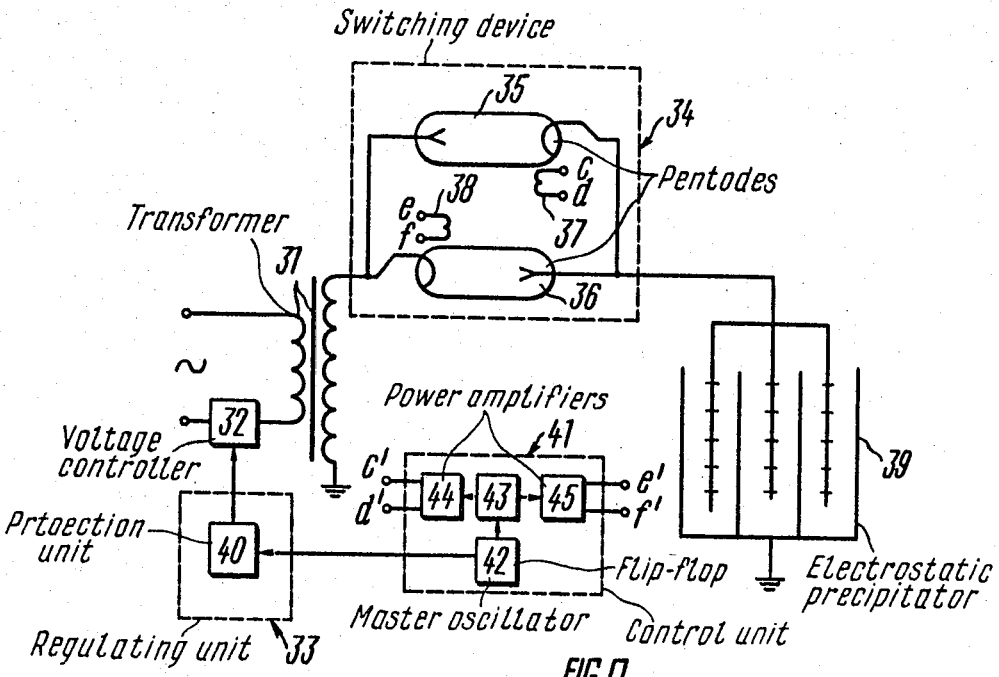
FIGS. 9, 10, 11 and 13 are diagrams of modifications of the other apparatus for supplying voltage to a high-ohmic dust electrostatic precipitator according to the invention.

When the required separation efficiency can be achieved with a supply voltage and current lower than their maximum values, it will be expedient to employ an apparatus of a simpler construction, which would provide supplying the precipitator with a voltage of inverting sign but with a half-wave rectification. In this case, as shown in FIG. 9, the apparatus comprises a step-up transformer 31 including a thyristor voltage controller 32 placed in series in the circuit of the primary winding of said transformer; a regulating unit 33; a switching device 34 including transit pentodes 35 and 36, each having a cathode, an anode, and a corresponding control solenoid 37 and 38 provided with leads c and d or e and f, the axis of each control solenoid being perpendicular to the axis of its corresponding pentode. The transit pentodes 35 and 36 of the switching device 34 are in inverse-parallel relationship and both are placed in series in a circuit of the secondary winding of the step-up transformer 31 and the electrostatic precipitator 39. In this case two modifications are possible which are explained below.

A first modification is shown in FIG. 9. In this modification one terminal of the secondary winding of the step-up transformer 31 is connected to the switching device 34 which is directly connected to the electrostatic precipitator 39.

Figure 10:
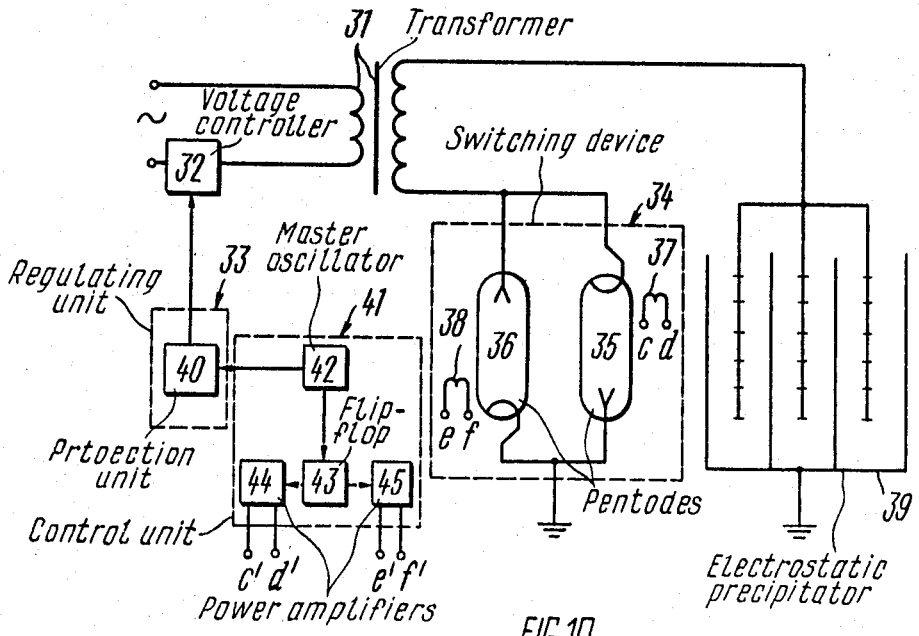

In a second modification shown in FIG. 10, one terminal of the secondary winding of the step-up transformer 31 is connected directly to the electrostatic precipitator 39, and the other terminal of said winding is connected to the switching device 34 which is grounded.

The regulating unit 33, like in the above modifications, includes a protection unit 40 provided with a thyristor key having its output connected with the input of the thyristor controller 32.

The apparatus of this modification also includes a control unit 41 incorporating the master oscillator 42, a flip-flop 43, and power amplifiers 44 and 45. One output of the master oscillator 42 is connected with a control electrode of the thyristor key in the protection unit 40, and the other output of said oscillator is connected to the input terminal of the flip-flop 43. The output terminals of the flip-flop 43 are connected to the leads of the power amplifiers 44, 45. The leads c′ and d′ of the power amplifier 44 are connected to the leads c and d of the control solenoid 37 of the transit pentode 35, and the leads e′ and f′ of the power amplifier 45 are connected to the leads e and f of the control solenoid 38 of the transit pentode 36.

The apparatus, the modifications of which are shown in FIGS. 9 and 10, operates as follows.

The control solenoids 37 and 38 are alternately fed with a supply current from the power amplifiers 44 and 45 of the control unit 41. In case the supply current flowing through the solenoid 37 and the solenoid 38 is in a no-current position, the transit pentode 35 is non-conducting, while the transit pentode 36 is conducting, the corona-forming electrodes being supplied with a voltage of a positive polarity. When the current flowing through the control solenoid 38 and the control solenoid 37 is in a no-current position, the corona-forming electrodes of the precipitator 39 are supplied with a voltage of a negative polarity. In this case each of the transit pentodes functions as a half-wave rectifier and a voltage switching device.

Before switching of voltage, the thyristor controller 32, in response to a signal from the master oscillator 42 of the control unit 41 applied to the protection unit 40, disconnects the step-up transformer from the supply line, and, after the switching operation is completed, the transformer 31 is connected again to the supply line.

The transit pentodes 35 and 36, which have a high internal dynamic resistance, cause the supply current to be limited when breakdowns occur, thereby eliminating arcing, and thus improving electric supply conditions in the electrostatic precipitator.

With the decrease in a load resistance of the precipitator, caused by changing in the characteristics of the dust-containing gas flow, the drop of voltage across the transit pentodes increases, which results in an excessive power. Therefore it will be useful to eliminate dessipation of the excessive power in the power source by regulating supply voltage with the aid of feedback, with the voltage across the transit pentodes decreasing.

Figure 11:
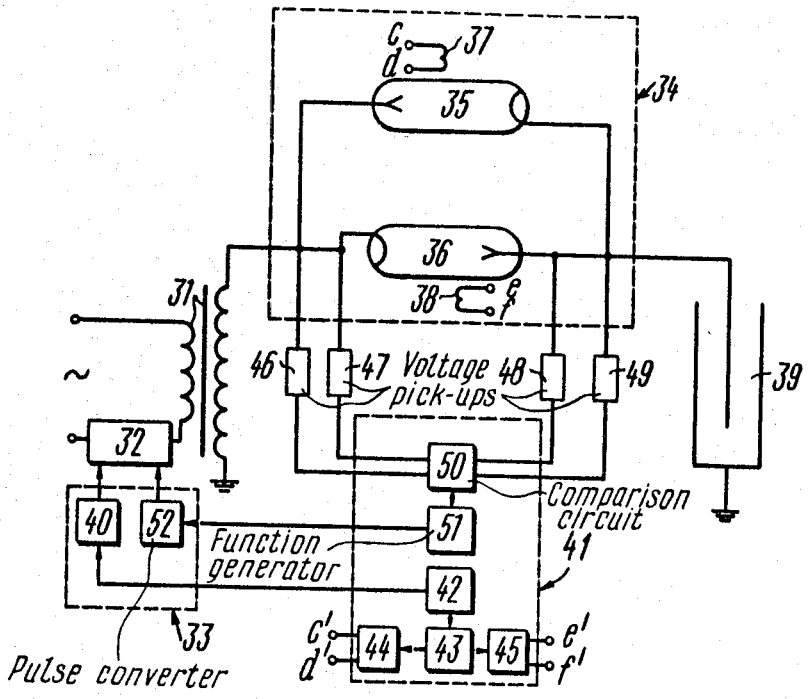

Shown in FIG. 11 is a construction of the apparatus wherein feedback control is used to provide for a minimum voltage drop across the transit pentodes. In addition, the apparatus also includes voltage pick-ups 46, 47, 48 and 49 mounted on the anode and cathode side of the transit pentodes 35 and 36. The control unit 41 further incorporates a comparison circuit 50 adapted to compare signals arriving from the pick-ups 46, 47, 48, and 49 with the reference voltage, and a function generator 51. The regulating unit 33 includes a pulse converter 52 which may be used for regulating the voltage in response to an external control signal.

The voltage pick-ups 46, 47, 48, and 49 are connected to the input of the comparison circuit 50 having its output connected through the function generator 51 to the input of the pulse converter 52 in the control unit 23.

When an excessive voltage occurs, for instance across the transit pentode 35, the increase in the difference of signals from the voltage pick-ups 46 and 47 causes a control signal to be formed at the output of the comparison circuit 50 in the control unit 41, which signal is applied to the pulse converter 52. In this case the regulating unit 33 with the aid of the thyristor controller 32 decreases the supply voltage applied to the apparatus, which practically eliminates the occurrence of an excessive voltage across the transit pentode 35.

Figure 12:
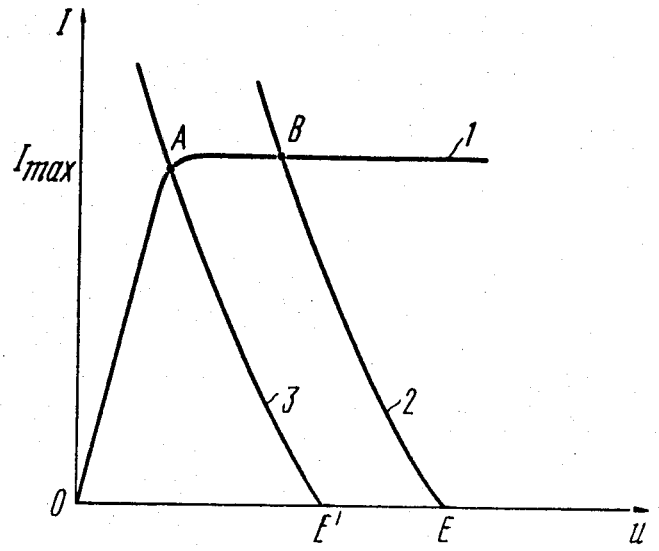
FIG. 12 is a graph, showing a volt-ampere characteristic (curve 1) of a transit pentode and load characteristics of the precipitator (curves 2, 3)

The operation principle of the apparatus using feedback control is illustrated in FIG. 12 showing a volt-ampere characteristic of the transit pentode 35 or 36 (curve 1) and load characteristics of the electrostatic precipitator 39 (curves 2 and 3).

When the apparatus operates, through the supply circuit of the precipitator flows a current the value of which depends on the voltage at the output terminal of the transformer 31, a current limit level in the transit pentode 35 or 36, and load characteristic of the precipitator 39.

The optimum operating condition of the apparatus is a condition of maximum current $I_{max}$ in the precipitator 39, with a minimum drop of voltage through corresponding transit pentodes. This condition at a supply voltage E corresponds to a corresponding point A at which the volt-ampere characteristic curve 1 and the load characteristic curve 2 of the precipitator cross one another.

When the load increases because of the decrease in the resistance of the precipitator 49, the working point displaces to the point B, in which case the current in the supply circuit does not increase since its value is limited by the transit pentode across which an excessive voltage drop occurs. In response to the drop in the voltage, sensed by the corresponding voltage pick-ups connected to the control unit 41, the voltage across the primary winding and at the output terminal of the transformer 31 decreases, thereby causing the rectified voltage at the output of the apparatus to decrease to a value E'. In this case the working point will again assume its position A, in which case no excessive voltage and power dissipation in the transit pentode will occur. This eliminates overheating of the apparatus and enhances the operation reliability thereof.

Figure 13:
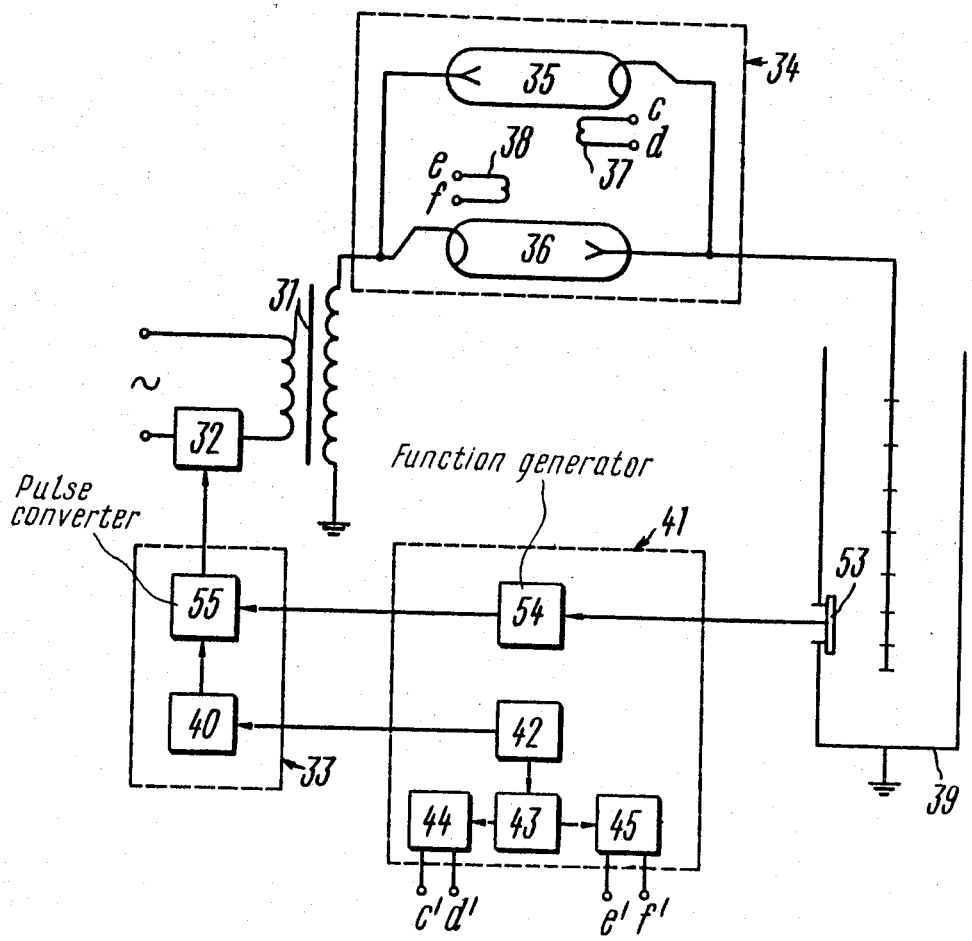

FIG. 13 shows a modification of the apparatus adapted to carry out the modification of the method wherein the supply voltage between no-voltage intervals is maintained at a pre-breakdown level.

The apparatus of this modification (FIG. 13) also includes a voltage pick-up 53 having one lead connected to the precipitation electrode of the precipitator 39. The control unit 41 further includes a function generator 54 having its input connected to the other lead of the voltage pick-up 53. The regulating unit 33 includes a pulse converter 56, placed in a circuit between the protection unit 40 and the thyristor controller 32 and has one input connected to the function generator 54.

In this modification the polarity of the voltage applied to the corona-forming electrode is periodically reversed in response to signals from the master oscillator 42, which signals are converted in the flip-flop 43 and amplified by the power amplifiers 44 and 45, reversing said polarity being effected with the aid of the transit pentodes 35 and 36 having control solenoids 37 and 38 respectively. After each reversal of the supply voltage polarity, the layer of dust on the precipitation electrode is recharged and the potential on the surface of said layer of dust increases again. With the potential increase the signal from the pick-up 53 also increases in proportion to said potential, which signal is transmitted through the function generator 54 to the pulse converter 55 in the regulating unit 33 and causes the controller 32 to increase the supply voltage proportionally to the signal from the pick-up to a pre-breakdown level. Maintaining the supply voltage at a maximum level allows increasing the electric field intensity in the electrostatic precipitator, thereby improving the efficiency thereof.

Figure 14:
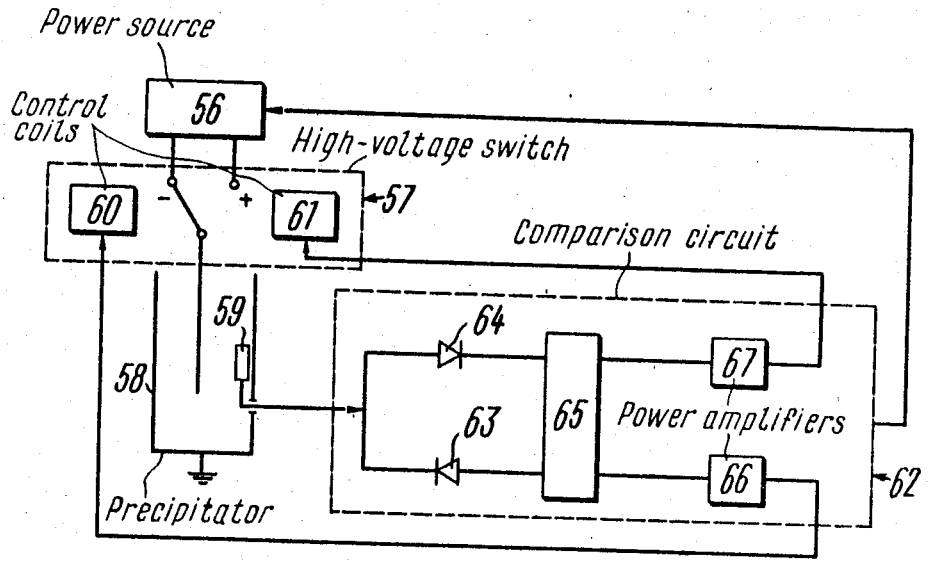
FIG. 14 is a diagram of still another apparatus for supplying voltage to a high-ohmic dust electrostatic precipitator according to the invention.

A modification of the apparatus shown in FIG. 14 is intended to carry out a modification of the proposed method wherein the length of the supply voltage pulse of each polarity between the no-voltage intervals is selected depending on the intensity of the electrical field in the layer of dust deposited on the precipitation electrodes.

The apparatus of this modification comprises a power source 56 having two high-voltage output terminals of opposite polarity, and a high-voltage switch 57 connected to the precipitator 58 provided with at least one electric field intensity transducer 59 mounted on the precipitation electrode of the precipitator.

Figure 4:
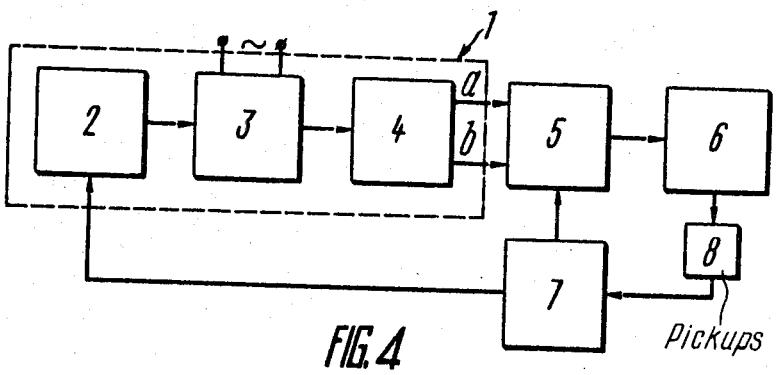
FIG. 4 is a block-diagram showing one modification of the method according to the invention.

The supply source 56 includes elements similar to those shown in FIGS. 3 and 4. The switch 57 is provided with control coils 60 and 61. The transducer 59 is connected to the control coils 60 and 61 through the control unit 62 which includes diodes 63 and 64, a comparison unit 65, and power amplifiers 66 and 67. The transducer 59 is connected through the diodes 63 and 64 to the input of the comparison circuit 65 having its output connected through the power amplifiers 66 and 67 to the coils 60 and 61 of the switch 57. The output of the control unit 62 is also connected to the input of the supply source 56.

The above apparatus operates as follows. When the intensity of the electric field in the layer of dust increases to the predetermined level which does not exceed the pre-breakdown level, a signal is applied from the transducer 59 to the comparison circuit 65 through the diode 63, and after comparing said signal with the reference voltage the comparison circuit 65 generates a control signal. This control signal after being amplified by the power amplifier 66 is applied to the input of the supply source 56 to disconnect the latter from the supply line for the period of the polarity-reversing operation in a similar manner as described above, and also to the coil 60 of the switch 57, which switch 57 in response to said signal operates to reverse the polarity of the supply voltage applied to the precipitator 58. After completion of the reversal operation the intensity of the electric field in the layer of dust increases at the opposite polarity. When said intensity assumes its predetermined value, a signal from the transducer 59 applied through the diode 64 to the comparison circuit 65 causes reversing of the polarity of the supply voltage with simultaneous disconnection of the power source 56 from the supply line. In this way the supply voltage polarity is periodically reversed, with the repetition frequency of the polarity reversal being determined by the rate of increase of the electric field intensity in the layer of dust deposited on the precipitation electrodes of the electrostatic precipitator.

Regulating the voltage of reversing polarity by the intensity of the electric field in the layer of dust enhances the dust cleaning efficiency, since reversing the voltage polarity before the electric field intensity in the layer of dust assumes its critical level rules out breakdowns in the layer of dust and a reversed corona discharge.

We claim:

1. A method of supplying voltage to a high-ohmic dust electrostatic precipitator having corona-forming and precipitation electrodes, comprising the steps of supplying voltage with periodically repeating interruptions in voltage supply, and reversing the supply voltage polarity during said interruptions, said reversing of the supply voltage polarity being delayed with respect to the beginning of said interruption in voltage supply.

2. A method of supplying voltage to a high-ohmic dust electrostatic precipitator as claimed in claim 1, wherein the duration of each of said interruptions in voltage supply is 0.01 to 0.05 seconds.

3. A method of supplying voltage to a high-ohmic dust electrostatic precipitator as claimed in claim 1, wherein the supply voltage between said interruptions in voltage supply is maintained at a pre-breakdown level, said supply voltage being regulated proportionally to variation of the potential of the layer of dust deposited on the precipitation electrodes of said electrostatic precipitator.

4. A method of supplying voltage to a high-ohmic dust electrostatic precipitator as claimed in claim 1, wherein the duration of applying a voltage of each polarity during the period between said interruptions in voltage supply is regulated by the intensity of the electric field in the layer of dust deposited on the precipitation electrodes of said electrostatic precipitator.

5. An apparatus for supplying voltage to a high-ohmic dust electrostatic precipitator having corona-forming and precipitation electrodes, comprising:

a step-up transformer having a primary winding connected to a supply line, and a secondary winding having one output terminal grounded;

a thyristor controller placed in series in the primary winding circuit of said step-up transformer, and having an input;

a switching device including:

a first transit pentode having a cathode lead and an anode lead, and a control solenoid whose axis is perpendicular to the axis of this transit pentode;

a second transit pentode having a cathode lead and an anode lead, said cathode lead of said second transit pentode being connected to the anode lead of said first transit pentode and a second terminal of the secondary winding of said transformer, and the anode lead of said second transit pentode being connected to the cathode lead of said first transit pentode, the common lead of said transit pentodes being connected to said corona-forming electrode of said electrostatic precipitator, and said second transit pentode having a control solenoid whose axis is perpendicular to the axis of this transit pentode;

a regulating unit incorporating a protection unit provided with a thyristor key and having a control electrode and a lead connected to said input of said thyristor controller; and a control unit including:

a master oscillator having two outputs, one of said outputs being connected to said control electrode of said thyristor key of said protection unit in said control unit;

a flip-flop having an input connected to a second of the outputs of said master oscillator, and output; and two power amplifiers, each having an input connected to one of the outputs of said flip-flop, and two outputs connected to a corresponding control solenoid of a respective pentode.

6. An apparatus for supplying voltage to a high-ohmic dust electrostatic precipitator as claimed in claim 5, further comprising:

four voltage pick-ups, each having two leads, one of said two leads being electrically connected to one of said leads of said first transit pentodes;

a comparison circuit incorporated in said control unit and having inputs connected with other leads of said voltage pick-ups, and an output;

a function generator incorporated in said control unit and having an input connected to the output of said comparison circuit, and an output and a pulse converter in said regulating unit, placed in a circuit between said protection unit and said thyristor controller, and having an input connected to said output of said function generator.

7. An apparatus for supplying voltage to a high-ohmic dust electrostatic precipitator as claimed in claim 5, further comprising:

a voltage pick-up having two leads, one of said leads being connected to the precipitation electrode of the electrostatic precipitator;

a function generator in said control unit having an input connected to the other lead of said voltage pick-up, and an output; and a pulse converter in said regulating unit placed in a circuit between said protection unit and said thyristor controller and having an input connected to said output of said function generator.

8. An apparatus for supplying voltage to a high-ohmic dust electrostatic precipitator having precipitation and corona-forming electrodes, comprising:

two step-up transformers, each said transformer having a primary winding for connecting to a supply line, and a secondary winding;

two thyristor controllers, each said thyristor controller being placed in series in the primary winding circuit of a corresponding step-up transformer, and having an input;

two high-voltage rectifiers, each said rectifier being placed in a circuit of a corresponding step-up transformer, and having two high-voltage leads of opposite polarity, the positive high-voltage lead of a first high-voltage rectifier and the negative high-voltage lead of a second high-voltage rectifier being grounded;

two transit pentodes connected in series with one another and each having a lead electrically connected to said corona-forming electrode of said electrostatic precipitator and the other transit pentode, a lead electrically connected with a respective high-voltage rectifier, and a control solenoid whose axis is perpendicular to the axis of the corresponding transit pentode;

two regulating units, each said regulating unit incorporating a protection unit provided with a thyristor key having a control electrode and two leads, each said lead being corrected to said input of said corresponding thyristor controller; and a control unit including:

a master oscillator having three outputs, of which two outputs being connected to said control electrode of said thyristor key in the protection unit of said corresponding regulating unit;

a flip-flop having an input connected to the third output of said master oscillator, and two outputs; and two power amplifiers, each said power amplifier having an input connected with one of the inputs of said flip-flop, and two outputs connected to a corresponding transit pentode.

9. An apparatus for supplying voltage to a high-ohmic dust electrostatic precipitator as claimed in claim 8, wherein a series connection of said transit pentodes is effected by directly connecting the cathode of one of said pentodes to the cathode of the other pentode, the common point of said cathodes being connected to the precipitator, the anode of a first transit pentode being connected to the negative high-voltage lead of said one high-voltage rectifier whose positive high-voltage lead being grounded, and the cathode of a second transit pentode being connected to the positive high-voltage lead of the other high-voltage rectifier whose negative high-voltage lead is grounded.

10. An apparatus for supplying voltage to a high-ohmic dust electrostatic precipitator as claimed in claim 8, wherein a series connection of said pentodes is effected through one of the high-voltage rectifiers, the anode of a first transit pentode is connected to the negative lead of the corresponding high-voltage rectifier having its positive high-voltage lead grounded, the cathode of this transit pentode is connected to the positive high-voltage lead of the other high-voltage rectifier having its negative lead grounded through a second transit pentode placed in a circuit composed of the high-voltage rectifier and ground and having its anode connected to the negative high-voltage lead of the high-voltage rectifier.

11. An apparatus for supplying voltage to a high-ohmic dust electrostatic precipitator having precipitation and corona-forming electrodes, comprising:

a power source having an input and two high-voltage leads of opposite polarity;

a high voltage switch to switch said high-voltage leads of said power source, and having two control coils and an output electrically connected to the corona-forming elecrode of said electrostatic precipitator;

an electric field intensity transducer having two leads, one of said leads being connected to the precipitation electrode of said electrostatic precipitator; and a control unit including:

two diodes, each having a positive and a negative lead, the positive lead of a first diode is connected to the negative lead of a second diode and a second lead of said electric field intensity transducer;

a comparison circuit having two inputs, a first input connected to the negative lead of said first diode, and a second input of said comparison circuit being connected to the positive lead of said second diode, and two outputs; and two amplifiers, each having an input connected to the corresponding output of said comparison circuit, and an output electrically connected to said corresponding control coil of said high-voltage switch.

* * * * *